US007337642B2

(12) United States Patent
Lyons et al.

(10) Patent No.: US 7,337,642 B2
(45) Date of Patent: Mar. 4, 2008

(54) ROLL-FORMER APPARATUS WITH RAPID-ADJUST SWEEP BOX

(75) Inventors: Bruce W. Lyons, Grand Haven, MI (US); Bryan E. Gould, Coopersville, MI (US); James H. Dodd, Tustin, MI (US); Richard D. Heinz, Grand Haven, MI (US)

(73) Assignee: Shape Corporation, Grand Haven, MI (US)

( * ) Notice: Subject to any disclaimer, the term of this patent is extended or adjusted under 35 U.S.C. 154(b) by 155 days.

(21) Appl. No.: 11/150,904

(22) Filed: Jun. 13, 2005

(65) Prior Publication Data

US 2006/0277960 A1 Dec. 14, 2006

(51) Int. Cl.
*B21D 5/04* (2006.01)

(52) U.S. Cl. ..... 72/129; 72/168; 72/173

(58) Field of Classification Search ..... 72/168, 72/130, 132, 307, 173–175
See application file for complete search history.

(56) References Cited

U.S. PATENT DOCUMENTS

| | | | | |
|---|---|---|---|---|
| 1,533,443 | A | 4/1925 | Miller | |
| 1,807,847 | A | 6/1931 | Kellogg | |
| 2,242,135 | A | 5/1941 | Mertz | |
| 2,279,197 | A | 4/1942 | Hoell | |
| 2,335,028 | A | 11/1943 | Rose et al. | |
| 3,076,491 | A * | 2/1963 | Bruderlin | 72/132 |
| 3,197,990 | A * | 8/1965 | Stubblefield | 72/131 |
| 3,452,568 | A | 7/1969 | Vihl | |
| 3,906,765 | A | 9/1975 | Foster | |
| 4,117,702 | A | 10/1978 | Foster | |
| 4,354,372 | A | 10/1982 | Inoue et al. | |
| 4,391,116 | A | 7/1983 | Yogo | |
| 4,530,226 | A | 7/1985 | Granzow et al. | |
| 4,624,121 | A | 11/1986 | Kitsukawa et al. | |
| 4,627,254 | A | 12/1986 | Kitsukawa et al. | |
| 4,796,449 | A | 1/1989 | Berne | |
| 4,850,212 | A | 7/1989 | Frey | |
| 4,893,489 | A * | 1/1990 | Mason | 72/10.2 |
| 4,910,984 | A | 3/1990 | Young et al. | |
| 5,036,688 | A * | 8/1991 | Gillean | 72/14.7 |

(Continued)

FOREIGN PATENT DOCUMENTS

DE 4210227 A1 9/1993

(Continued)

*Primary Examiner*—Daniel C Crane
(74) *Attorney, Agent, or Firm*—Price, Heneveld, Cooper, DeWitt & Litton LLP

(57) ABSTRACT

A computer controlled roll-forming apparatus is adapted to provide a repeating pattern of different longitudinal shapes to a continuous beam "on the fly" during the roll-forming process. A sweep station on the apparatus includes a primary bending roller tangentially engaging the continuous beam along the line level and an armature for biasing the continuous beam against the primary bending roller for a distance partially around a downstream side of the primary bending roller to form a sweep. Further, actuators adjustably move the armature at least partially around the downstream side of the primary bending roller between at least first and second positions for imparting multiple different longitudinal shapes into the continuous beam. In one form, the apparatus also includes a coordinated cut-off, so that when separated into bumper beam segments, the ends of the individual beam segments have a greater sweep than their center sections.

23 Claims, 6 Drawing Sheets

U.S. PATENT DOCUMENTS

| | | | |
|---|---|---|---|
| 5,092,512 | A | 3/1992 | Sturrus et al. |
| 5,187,963 | A | 2/1993 | Sutton, Jr. et al. |
| 5,197,959 | A | 3/1993 | Buell |
| 5,425,257 | A | 6/1995 | Kitsukawa et al. |
| 5,884,517 | A | 3/1999 | Yogo |
| 5,934,544 | A | 8/1999 | Lee et al. |
| 5,974,932 | A | 11/1999 | Suzuki et al. |
| 6,042,163 | A | 3/2000 | Reiffer |
| 6,079,246 | A | 6/2000 | Caporusso et al. |
| 6,240,820 | B1 | 6/2001 | Sturrus et al. |
| 6,318,775 | B1 | 11/2001 | Heatherington et al. |
| 6,349,521 | B1 | 2/2002 | McKeon et al. |
| 6,386,011 | B1 | 5/2002 | Levy |
| 6,598,446 | B2 | 7/2003 | Meliga |
| 6,695,368 | B1 | 2/2004 | Weykamp et al. |
| 6,813,920 | B2 | 11/2004 | Yoshida et al. |
| 6,820,451 | B2 | 11/2004 | Renzzulla et al. |
| 2002/0174700 | A1 | 11/2002 | Meliga |
| 2004/0164566 | A1 | 8/2004 | Jaeger et al. |

FOREIGN PATENT DOCUMENTS

| | | | |
|---|---|---|---|
| EP | 0 362 698 | * | 4/1990 |
| JP | 61-17576 | | 5/1986 |
| JP | 402015831 A | | 1/1990 |

* cited by examiner

ROLL-FORMER APPARATUS WITH RAPID-ADJUST SWEEP BOX

BACKGROUND

The present invention relates to a roll-forming apparatus with a sweep station adapted to impart multiple sweeps (i.e., non-uniform longitudinal curvatures) into a roll-formed beam.

Roll-formed bumper beams have recently gained wide acceptance in vehicle bumper systems due to their low cost and high dimensional accuracy and repeatability. Their popularity has increased due to the ability to sweep (i.e., provide longitudinal curves) in the roll-formed beam sections in order to provide a more aerodynamic appearance. For example, one method for roll-forming a constant longitudinally curved beam is disclosed in Sturrus U.S. Pat. No. 5,092,512.

The aerodynamic appearance of vehicle bumpers is often further enhanced by forming a section of the front surface at ends of the bumpers rearwardly at an increased rate from a center of the bumper beam. This is typically done by secondary operations on the bumper beam. Exemplary prior art secondary operations for doing this are shown in Sturrus U.S. Pat. No. 5,092,512 (which discloses deforming/crushing ends of tubular beam), and are also shown in Sturrus U.S. Pat. No. 6,240,820 (which discloses slicing ends of a beam and attaching brackets), Heatherington U.S. Pat. No. 6,318,775 (which discloses end-attached molded components), McKeon U.S. Pat. No. 6,349,521 (which discloses a re-formed tubular beam), and Weykamp U.S. Pat. No. 6,695,368 and Reiffer U.S. Pat. No. 6,042,163 (which disclose end-attached metal brackets). However, secondary operations add cost, increase dimensional variability, and increase in-process inventory, and also present quality issues. It is desirable to eliminate the secondary operations required to form the bumper ends with increased rearward sweep. At the same time, vehicle manufacturers want to both maintain low cost and provide flexibility in bumper beam designs. Thus, there are conflicting requirements, leaving room for and a need for the present improvement.

It is known to provide computer controls for bending and roll-forming devices. See Berne U.S. Pat. No. 4,796,449, Kitsukawa U.S. Pat. No. 4,624,121, and Foster U.S. Pat. No. 3,906,765. It is also known to make bumper beams with multiple radii formed therein. For example, see Levy U.S. Pat. No. 6,386,011 and Japan Japan patent document JP 61-17576. Still further, it is known to bend tubing and beams around the arcuate outer surface of a disk-shaped mandrel by engaging the tube to wrap the tube partially around the mandrel until a desired permanent deformation occurs. For example, see Miller U.S. Pat. No. 1,533,443 and Sutton U.S. Pat. No. 5,187,963. Nonetheless, it is important to understand that bumper beams for modern vehicles present a substantial increase in difficulty due to their relatively large cross-sectional size and non-circular cross-sectional shape, the high strength of materials used herein, the very tight dimensional and tolerance requirements of vehicle manufacturers, the cost competitiveness of the vehicle manufacturing industry, and the high speed at which modern roll-forming lines run.

Notably, existing sweep mechanisms on roll-forming equipment are often made to be adjustable. For example, Sturrus '512 discloses a manually adjustable sweep station. (See as Sturrus '512, FIGS. 10-11, and column 6, lines 1-9.) However, even though the sweep station is adjustable, it does not necessarily mean that the apparatus is able to manufacture beams having multiple sweep radii therein. For example, since the sweep station in the apparatus of Sturrus '512 is manually adjustable, as a practical matter it cannot be adjusted quickly enough to allow formation of regularly-spaced different curves in a single vehicle bumper beam section. Notably, bumper beams are usually only about 4 to 5 feet long and roll-forming line speeds can reach 4000 to 5000 feet per hour, such that any change in sweep must be accomplished relatively quickly and very repeatably. Certainly, non-uniform longitudinal curvatures cannot be uniformly repeated formed along a length of a continuous beam by manual means and further cannot productively and efficiently be made in high speed rollforming operations using slow-acting automated equipment. Accordingly, there remains a need for a method and roll-forming apparatus capable of manufacturing a roll-formed beam with different radii along its length "on the fly" (in other words simultaneously as part of the roll-forming process), where the method and apparatus do not require substantial secondary operations (or at least they require less secondary processing), such as cutting, fixturing, welding, secondary forming and/or post-roll-forming attachment of bracketry.

Renzzulla U.S. Pat. No. 6,820,451 is of interest for disclosing a power-adjusted sweep station. As best understood, Renzzulla '451 discloses an adjustable sweep station for a roll-forming apparatus where an upstream roller (16) is followed by an adjustable carriage adjustment assembly (14) that incorporates a primary bending roller (18) and an adjustable pressure roller (20) forming a first part of the sweep mechanism (for coarse adjustment of sweep), and also an auxiliary roller (22) forming a second part (for fine adjustment of sweep) (see Renzzulla '451, column 14, lines 20-22.). In Renzzulla '451, the lower primary roller (18) (i.e., the roller on the downstream/convex side of the swept beam) is preferably positioned above the line level of the beam being roll-formed (see FIG. 1, "flexing roller 18 is vertically higher than the line level", see column 10, line 65 to column 11 line 1.) The second roller (20) (i.e., the roller on the concave side of the swept beam) is supported for adjustable arcuate movement around the axis (shaft 90) of the first roller (see FIGS. 15-16) to various adjusted positions for putting pressure on the continuous roll-formed beam. Actual flexure of the beam occurs upstream of the rollers (18/20) at location 143. (See column 12, line 45-46.) A control assembly (130) is adapted to move the roller (20) along its arcuate path of adjustment. (See column 8, line 62+, and see FIGS. 1-2). An auxiliary carriage assembly (110) is positioned to adjust roller (22) on the primary carriage assembly (14) and is adjustable by operation of an adjustment assembly (137). The patent indicates that both adjustments can be done "on the fly" (see column 14, line 4), and that the primary and auxiliary assemblies can be adjusted for coarse and fine sweep adjustments, respectively. (See column 14, line 22).

Although the device disclosed in the Renzzulla '451 patent can apparently be power-adjusted while the roll-forming apparatus is running, the present inventors find no teaching or suggestion in Renzzulla '451 for providing a controlled/timed adjustment function nor coordinated control function for repeatedly adjusting the device to provide a repeated series of dissimilar sweeps (i.e., different radii) at selected relative locations within and along the length of a single bumper beam segment (e.g., within a span of about 4 to 5 feet as measured along a length of the roll-formed continuous beam). Further, there is no teaching in Renzzulla '451 to form a multi-swept beam using a computer controlled sweep apparatus in continuation with a coordinated computer-controlled cut-off device adapted to cut off individual bumper beam sections from the continuous beam at specific locations related to particular sweep regions. Further, based on the density of threads suggested by the FIGS. 1-2 (and also based on the lack of any discussion in Renzzulla '451 regarding automated "cyclical" adjustment), it appears that the device of Renzzulla '451 suffers from the same problem as manually adjustable sweep stations—i.e., that it cannot be adjusted fast enough to cause multiple sweeps within a 4 to 5 foot span along the continuous roll-formed beam, given normal relatively fast linear speeds of roll-forming mills.

There is potentially another more fundamental problem in sweep station of the Renzzulla '451 patent when providing tight sweeps (i.e., sweeps with short radii) along a continuous beam. The Renzzulla '451 patent focuses on a sweep station where a first relatively stationary (primary) forming roller (18) is positioned above a line level of the continuous beam (see column 10, line 65 to column 11 line 1) to deflect a continuous beam out of its line level, and discloses a second movable/adjustable pressure roller (20) that is adjustable along an arcuate path around the axis of the first relatively-stationary (primary) roller (18) in order to place bending forces at a location (143) forward of (upstream of) the primary roller (18) . . . the upstream location (143) being generally between and upstream of the primary roller (18) and the upstream support roller (16). (See FIG. 16, and column 12, lines 45-46). As the Renzzulla sweep mechanism is adjusted to form tighter and tighter sweeps (i.e., sweeps with increasingly smaller radii), the location (143) of bending potentially moves even farther upstream and away from the primary roller (18). By forcing flexure and deformation of the beam to occur at an unsupported upstream location (143), the beam walls effectively are allowed to bend in an uncontrolled fashion. This makes it very it difficult to control twisting and snaking, difficult to control undesired warping and wandering, and also difficult to control dimensional variations. These variables combine and lead to unpredictability of deformation in the beam and the beam walls. In other words, as the unsupported distance increases (i.e., as tighter sweeps are formed), the problem of uncontrolled movement and deflection of the beam walls becomes worse . . . potentially leading to dimensional and quality problems. Compounding this problem is the fact that the diameter of rollers 16 force the rollers 16 to be positioned away from the rollers 18 and 20 . . . which results in the contact points of the rollers 16 and 18 against the beam to be a relatively large distance equaling basically the distance between the axles on which the rollers 18 and 20 rotate. This large unsupported distance allows the walls of the roll-formed beam to wander and bend uncontrollably as deformation occurs in this area of no support.

Thus, a system having the aforementioned advantages and solving the aforementioned problems is desired.

SUMMARY OF THE PRESENT INVENTION

In one aspect of the present invention, an apparatus includes a roll-forming apparatus adapted to roll-form a sheet of material into a continuous beam having a longitudinal line level, the continuous beam having a first surface and an opposing second surface. The apparatus further includes a sweep station in-line with the line level and adapted to form a longitudinal shape into the continuous beam. The sweep station includes a primary bending roller tangentially engaging the continuous beam along the line level and an armature for holding the continuous beam tightly against the primary bending roller for a distance partially around a downstream side of the primary bending roller to form a sweep. The sweep station further includes actuators for adjustably moving the armature at least partially around the downstream side of the primary bending roller between at least first and second positions for imparting at least first and second different longitudinal shapes, respectively, into the continuous beam.

In another aspect of the present invention, an apparatus includes a roll-forming apparatus adapted to roll-form a sheet of material into a continuous beam having a line level, the continuous beam having a first surface and an opposing second surface. A sweep station is positioned in-line with and downstream of the roll-forming apparatus and adapted to form a longitudinal shape into the continuous beam. The sweep station includes a first roller and a second roller opposite the first roller that opposes the first roller to pinch the continuous beam therebetween and also includes a mechanism for controllably adjusting a position of the second roller. The first roller is positioned to tangentially engage the first surface of the continuous beam and is maintained in a relatively stationary position when roll-forming the continuous beam. The second roller is also positioned to tangentially engage the second surface of the continuous beam. The first roller defines a first axis of rotation and the second roller is movable by the mechanism along an arcuate path around an adjustment axis that is on a same side of the continuous beam as the first axis and that is located at or upstream of the first axis so that, upon adjustment, the second roller moves toward a position that is more downstream relative to the first roller.

In another aspect of the present invention, an apparatus includes a sweep apparatus including axles for supporting rollers that are adapted to form a sweep into a continuous beam. An armature is operably mounted on a stationary one of the axles, the armature supporting at least a particular one of the rollers for imparting a sweep into the continuous beam. An automated adjustment device is provided for repeatedly arcuately adjusting an angular position of the armature to create a repeating pattern of longitudinal shapes in the continuous beam, including automatically moving the particular one roller toward different downstream positions relative to the other roller to change the sweep being imparted into the continuous beam.

In yet another aspect of the present invention, an apparatus includes a sweep apparatus having a primary bending roller tangentially engaging the continuous beam. An opposing holding roller is adjustable to different positions downstream of the primary bending roller and holds the continuous beam against the primary bending roller to cause a desired sweep to be imparted into the continuous beam. At least one stabilizing roller tangentially engages the continuous beam upstream of the primary bending roller. First, second, and third drive motors drive the primary bending roller, the holding roller and the stabilizing roller, respectively. A controller independently controls a drive speed of each of the first, second, and third rollers to control and manage stress on the continuous beam while in the sweep station in order to form a more consistent swept shape of the continuous beam.

In still another aspect of the present invention, a method includes steps of providing a sheet of high strength material having a tensile strength of at least 80 KSI; providing a roll-forming apparatus capable of forming the sheet at speeds of at least about 900 feet per hour, the roll-forming apparatus including an adjustable sweep station, an actuator, and a controller operably connected thereto for automatically rapidly adjusting the sweep station to generate different sweep radii; and roll-forming the sheet to form a continuous beam having a continuous cross section and, simultaneous with and near an end of the roll-forming, sequentially and repeatedly imparting different sweeps while running the roll-forming at a line speed of at least about 900 feet per hour.

The present apparatus focuses on a sweep station where a roll-formed continuous beam is received and tangentially engages a first forming roller, and draws or "wraps" the continuous beam partially around the stationary roller, doing so by moving the gripping point circumferentially around a downstream side of the primary roller until the continuous beam takes on enough permanent deformation to retain the desired amount of sweep. The present apparatus focuses on gripping the beam at a tangential position at the primary roller, with the primary roller being tangentially in-line with the line level of the continuous beam. The present apparatus then provides structure for wrapping the continuous beam partially around the stationary roller downstream of the primary roller as the continuous beam continues to tangentially/circumferentially engage the primary roller, with the pinch point moving circumferentially around the stationary roller toward a downstream side of the primary roller during any adjustment of the sweep function on the continuous beam.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
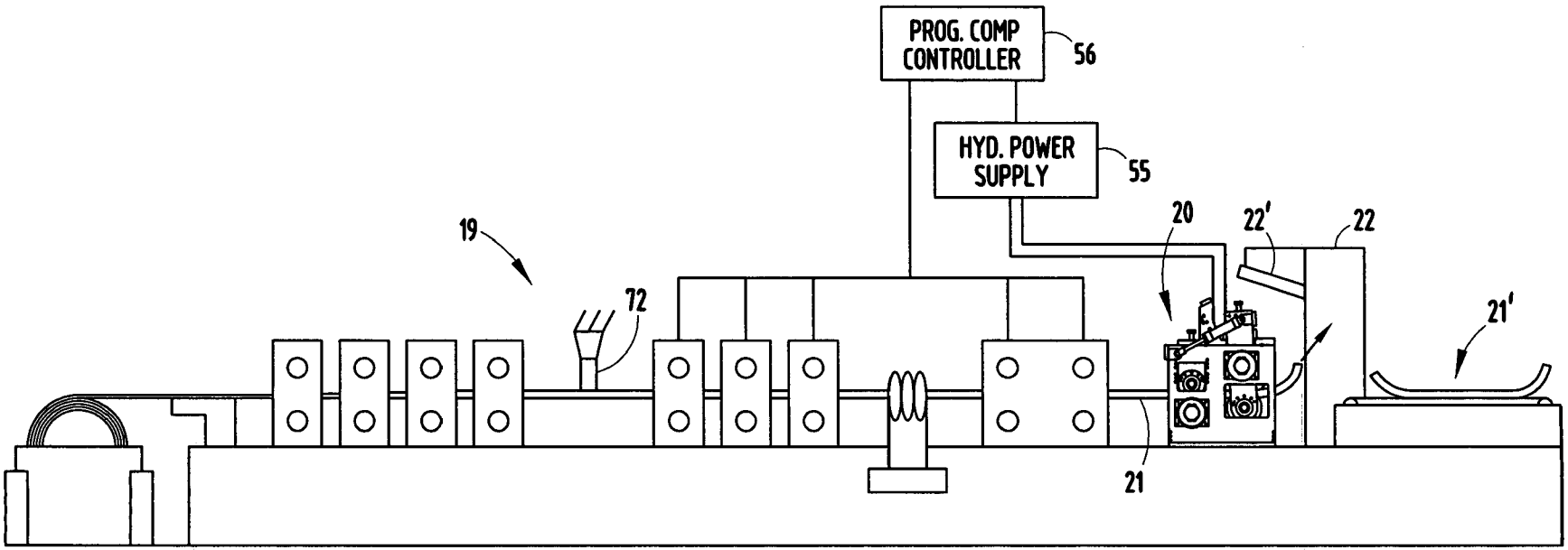
FIG. 1 is a roll-forming mill including a sweep station and sweep controller embodying the present invention.

The present roll-former mill apparatus 19 (FIG. 1) is adapted to make roll-formed vehicle bumper beams 21' (also called "bumper beam segments" or "reinforcement beams" herein) having a constant cross-sectional shape and consistent dimensional shape, but having a varied longitudinal curvature formed by a sweep station 20. The sweep station 20 is positioned in-line with and at an output end of the roll-former apparatus 19. The roll-forming portion of the apparatus 19 is not unlike that shown in FIG. 4 of Sturrus U.S. Pat. No. 5,092,512, and the teachings of the Sturrus '512 patent are incorporated herein in their entirety. The present sweep station 20 includes a multi-roller system that is computer-controlled and automated and that is arranged to permit quick accurate adjustment, allowing the sweeping operation to be repeatedly varied during the roll-forming process in order to form uniform dissimilar sweep radii along a length of the beam segments as an integral part of the roll-forming process. A coordinated/timed cut-off device 22 is operably connected to the computer control and adapted to cut the continuous beam 21 into bumper beam segments 21' for use in vehicle bumper systems. By controlling the degree and timing of the sweep imparted into the beam 21 based on part position, separated bumper beams 21' can, for example, be provided with end sections having an increased degree of sweep (i.e., more curved at the fenders) and a center section having a reduced degree of sweep (i.e., less curved across the radiator/grill area). It is conceived that, where the same rolls are used and the same bumper section is used and where only the sweep is changed, a change from one beam profile to another beam profile could be made "on the fly" via computer control, thus eliminating tool change time, eliminating set-up time, and eliminated "start-up" scrap. The present sweep station is shown in connection with a "C" shaped beam, but it is contemplated that it could also be used in a "W" beam section, or in a "D" or "B" shaped beam, or for making other beam sections.

Figure 2A:
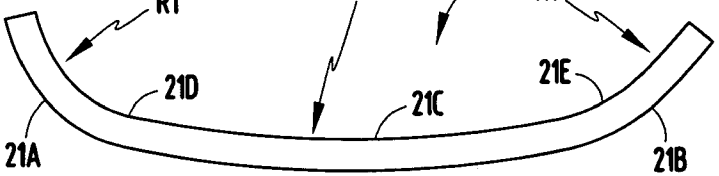
FIGS. 2-2A are exemplary beams having different sweeps along their lengths and made from the mill of FIG. 1.
Figure 2:
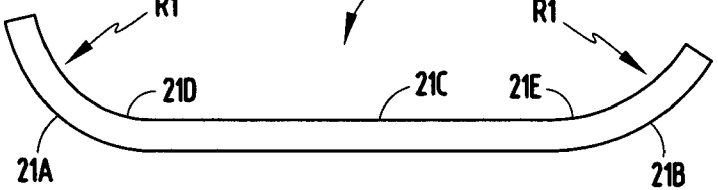

The illustrated roll-formed segmented beam 21' (FIG. 2) is C-shaped and includes end sections 21A and 21B having a radius R1, a center section 21C that is either linear (FIG. 2) (i.e., the radius equals infinity) or that has a different longer radius R2 (FIG. 2A), and that has transition zones 21D and 21E connecting the center and end sections. In an actual beam (21'), the radii R1 and R2 may not be as drastically different as those illustrated in FIGS. 2 and 2A, but the illustrations show the capability of the present apparatus. Also, it is conceived that the radius of the sweep may be made to be constantly changing along the entire length of the beam 21' (i.e., the center section may not have a single continuous radius R2), and/or there will be a more "blended" transition zone connecting the center to the ends of the beam, and/or the center section can be linear (or even reversely bent). It is contemplated that the present bumper beam section can be made from any material of sufficient strength and properties for functioning as a vehicle bumper beam. The illustrated bumper beam material is a sheet of ultra high strength steel (UHSS) material having a tensile strength of 80 KSI or more, or preferably having a tension strength of at least 120 KSI, but the tensile strength can be 220 KSI or more (e.g., a martensitic steel material).

The illustrated roll-forming apparatus is capable of line speeds that can reach 5000 feet per hour (or more), and is adapted to make tubular or open beam sections having cross-sectional dimensions of, for example, up to 4×6 inches (more or less). The illustrated sweep station 20 (FIG. 1) is intended to be positioned in-line with and at an end of a roll-forming apparatus (mill). It is contemplated that different cut-off devices could be used. For example, see the cut-off apparatus shown in Heinz U.S. Pat. No. 5,305,625, the teachings and disclosure of which are incorporated herein in their entirety. The cut-off apparatus 22 of the present apparatus includes a shear-type cut-off blade 22' whose actuation is controlled by a computer controller 56 (or a coordinated controller), so that bumper beams 21' can be cut at strategic locations along the continuous tubular beam 21. The illustrated cut-off 22 is programmed to extend and cut at a middle of a section of tight sweep in the bumper beam 21', so that half of the tight sweep (e.g., section 21A)

ends up being on each successive bumper beam 21' and the other section (e.g., 21B) ends up being at the other end of each successive bumper beam 21'. The cut-off device is positioned "downstream" of the sweep station but relatively close thereto for space savings and to reduce undesired wrap-back of the continuous beam as it exits the sweep forming station. The cut-off device 22 is controlled by the computer so that the beams 21', when separated from the continuous beam 21, have the desired end-to-end symmetry. It is conceived that the cut-off device could be incorporated into the sweep station itself at a location close to the end of the adjustable rolls causing the sweep, if desired. For example, the cut-off device could be attached to and move with the subframe 35, discussed below.

The sweep station 20 (FIGS. 3 and 4) includes a base or main frame 23 comprising a horizontal bottom plate 24 and fixedly attached vertical mounting plates 25. One or more stabilizer plates 25A and bridges 25B are added to stabilize the plates 24-25 and to maintain their relative squareness. A first half 26 of the sweep station 20 includes top and bottom axles 27 and 28 carrying forming rollers 60 and 61, respectively, and top and bottom bearings 29 and 30 rotatably mounting the axles 27, 28 to the vertical plates 25 for supporting forming rollers 60 and 61, respectively.

The top bearing 29 is manually vertically adjustable by a threaded support mechanism 29A in order to manually change a distance between the axles 27 and 28 (i.e., to change a "pinch" pressure of the rollers). Similar manual adjustment designs are known in the prior art, and are used on roll-forming machines to accommodate different sized roll dies for making different size beam cross sections. Notably, adjustment is typically done manually as part of setting up the roll-forming apparatus and during initial running of the roll-forming apparatus, and is typically not done as part of operating the roll-forming apparatus in production to form beams with constantly changing sweeps and repeated sweep profiles.

Figure 9:
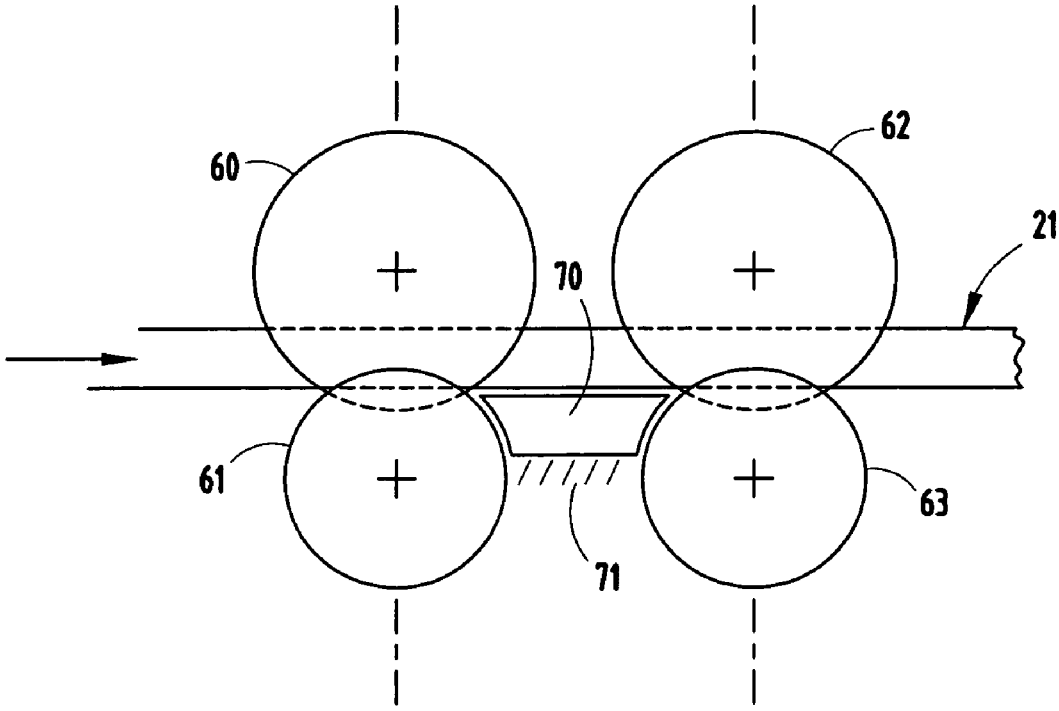
FIGS. 9-9A are side views of the four main rollers of FIG. 4, FIG. 9 showing the rollers positioned to pass a linear beam section and FIG. 9A showing the rollers positioned to form a swept beam.

A significant part of the present invention is the automatic "cyclical" adjustability and quick/accurate adjustability of the "second half" assembly 30A (FIG. 4) of the sweep station 20. The second half 30A includes a rigid subframe 35 (also part of the "armature") that is adjustably positioned between the main vertical plates 25. The subframe 35 has an inverted "U" shape and comprises a pair of inside vertical plates 36 and a spacer block 38 secured together as a rigid assembly. The inside vertical plates 36 are rotatably mounted on a top axle 31 by bearings 33A. The top axle 31 is made to be vertically adjustable on the outer vertical plates 25 much like the top axle 27 is made to be vertically adjustable in the first part of the sweep station in order to change the pinch pressure of the rollers. A bottom axle 32 and bearings 34 are mounted to a lower end of the inside vertical plates 36. The subframe 35 is rotatably angularly adjustable on axle 31 between the outer vertical plates 25. When rotated, the subframe 35 moves bottom axle 32 and the bottom rollers 63 mounted to it along an arcuate path P1 (FIG. 9A) to a new position on a downstream side of the top rollers 62 on the top axle 31. (See FIGS. 9 and 9A.) In an angularly adjusted position (FIG. 9A), the bottom roller 63 in the second half 30A causes the continuous beam 21 to wrap partially around the top roller 62 sufficiently to cause the continuous beam 21 to take on a permanent arcuate deformation (i.e., a longitudinal curvature or sweep). In other words, the bottom roller 63 effectively acts as a retaining device to hold the continuous beam 21 against (or close to) a circumferential surface of the top roller 62 for a selected distance as the continuous beam 21 extends tangentially past (i.e., around) the roller 63.

Figure 4:
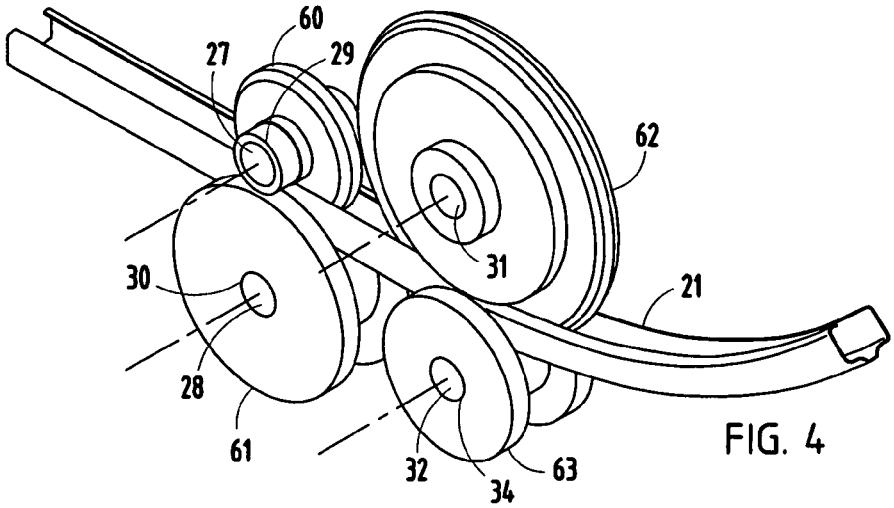
FIG. 4 is a perspective view similar to FIG. 3, but showing only the four main rollers of the sweep station of FIG. 3.

The location and timing of the angular movement of the armature (i.e., subframe 35 and roller 61) and also the timing of the cut-off device 22 is controlled by a controller 56 which controls the actuation system via circuit 55 (FIG. 4). The "wrapping" action of the roller 63 as it moves around roller 62 provides a simple and short motion that results in good dimensional control and consistency of the finished segmented beam 21', so that the beam segment 21' is symmetrical and can have a relatively tight sweep at each end. The walls of the continuous beam 21 are preferably well supported by the primary (top) roller 62 during the bending process, since the bending begins to occur at or very close to the top roller 62 and further occurs as the continuous beam 21 is drawn around the top roller 62. By careful and quick adjustment of the subframe 35, the continuous beam 21 ends up with a predictable multi-curved shape, which after being cut into bumper beam segments 21' eliminates the need for significant amounts of substantial secondary processing to rearwardly deform the ends of the beam 21'.

Especially when a relatively sharp sweep (i.e., small radius sweep) is being formed, maximum control over the walls of the continuous beam 21 is required. This is particularly true when ultra high strength materials are used and/or when different sweeps are being imparted into the continuous beam 21, since these tend to result in greater dimensional variation in the walls. Notably, the axles 31/32 are preferably positioned as close as practical to the axles 27, 28 so that the distance between the rollers is minimized. Of course, the size of the rollers 60, 61, and 62, 63 affects how close the axles 27, 28 and 31, 32 can be positioned. It is noted that angular adjustment of the subframe 35 along path P1 (FIG. 9A) also moves the bottom axle 32 away from the other bottom axle 27. In order to provide extra support between the bottom rollers 61 and 63, a secondary bridge support (either a sliding-type support or a multi-wheel-like roller support) can be added between the rollers 61 and 63 to support the bottom and/or sides of the continuous beam 21 as discussed below. Where a roller-type support is provided, the roller support can rotate about a horizontal or vertical axis of rotation that extends parallel the wall on the beam 21 being supported. (In other words, a rolling support that supports a side wall would rotate about a vertical axis, while a rolling support that supports a bottom wall would rotate about a horizontal axis.) It is noted that additional support can also be added either upstream or downstream of the critical rollers 62 and 63.

It is also important to note that the amount of "wandering", twisting, snaking, and uncontrolled back-and-forth bending of different walls on the continuous beam 21 can be minimized by maximizing tensile stresses during sweep-forming bending and minimizing compressive forces during sweep-forming bending. We, the present inventors, have discovered that independent drives on each of the axles for independently driving the rollers 60-63 can have a very advantageous effect. By driving each roller 60-63 at optimal speeds, stresses along the various walls of the continuous beam 21 can be optimally controlled. Notably, one reason that it is important to independently control individual roller rotation speeds is because it is not always easy to calculate exactly what speed individual rollers should be driven at. For example, a top roller (62) may contact the beam 21 along a top wall as well as along a bottom wall, such that one of the contact points must necessarily slip a small amount. Secondly, as a sweep is imparted into the continuous beam 21, the speed of rotation of rollers 62 and 63 will change, depending on the sweep. Still further, different cross-sectional shapes will undergo complex bending forces during the sweeping process, such that some on-the-floor adjustment of axle speeds will be necessary while operating the roll mill to determine optimal settings. It is important that compressive stresses be minimized, because compressive stresses (and not tensile stresses) have a greater tendency to cause the walls of the beam to form undulations and wave-like shapes that are difficult to predict or control. Accordingly, the independent drive motors allow the rollers to be rotated at individualized (different) speeds that "pull" top and bottom regions of the beam 21 through the sweep station, yet without causing any of the rollers to slip or spin or to "fight" each other. The drives for the different axles are independently controlled by the computer controller that is also operably connected to the roll mill, such that overall coordinated control of the machine is possible, including all aspects of the sweeping station.

Figure 3:
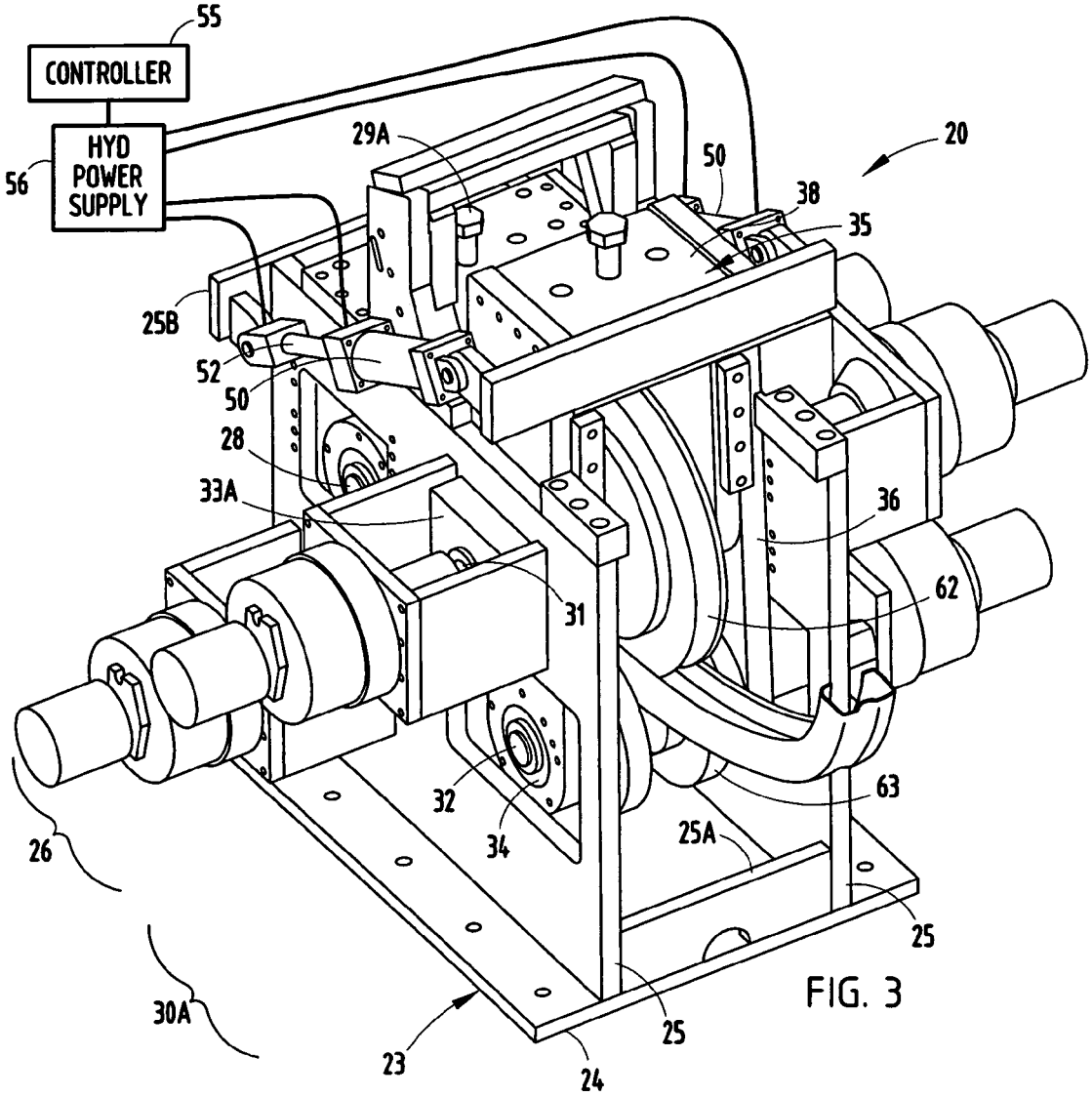
FIG. 3 is a perspective view of the sweep station of FIG. 1.

In the illustrated arrangement of FIG. 3, each of the axle shafts 27, 28, 31, 32 are independently driven by an infinitely variable speed drive (e.g., servo motors) controlled by the controller 56. The speeds can be changed on the fly during the roll-forming process in response to a preprogrammed sequence and timing program input into the controller 56. It is contemplated that a speed of the various shafts 27, 28, 31, 32 will be associated with a speed of the roll-forming process and with a position of the rollers relative to the continuous beam 21 (i.e., as affected by the degree of sweeps imparted to the beam 21 by the rollers 62 and 63) on the roll-form apparatus. Multiple different sweeps can be made within individual bumper beam segments 21' (prior to separating the beam segments 21' from the continuous beam 21). Alternatively, gradually increasing or decreasing sweeps can be made (instead of a constant radius sweep). By making the drive mechanisms and axle speeds independently controlled and the tangential roller speeds at the sweep station different from the roll-forming apparatus, better and more consistent control over sweep radii can be achieved. It is contemplated that an auxiliary roller is not required for the present apparatus, though one can be added, if desired. It is contemplated that the angular position of the roller 63 relative to roller 62 will be controlled by a servo drive controlled by the controller 56. The servo and controller provide speed control in a closed loop integrally tied with the roll-forming apparatus, the speed being a programmable feature of the controller.

Figure 9A:
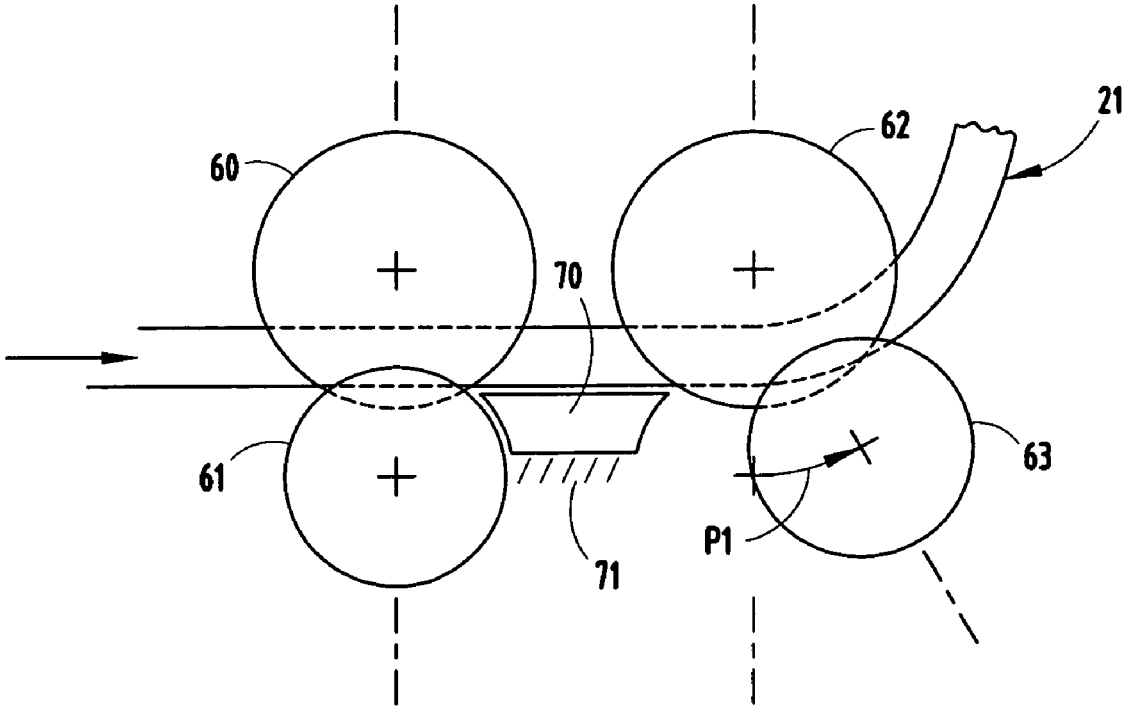
Figure 10:
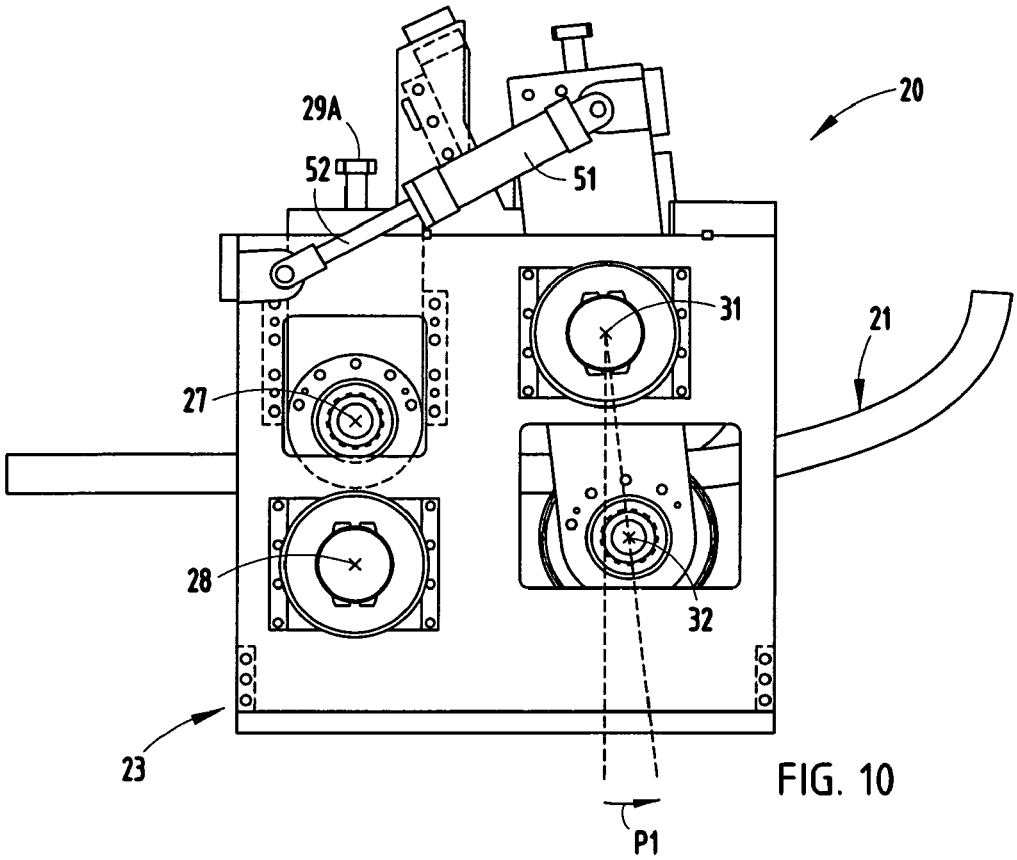
FIGS. 10-11 are side views of the sweep station of FIG. 3, FIG. 10 showing the sweep station adjusted to a position for forming a tight sweep (with small radius) in the continuous beam and FIG. 11 showing the sweep station adjusted to a position for forming a shallower sweep (with larger radius) in the continuous beam.
Figure 11:
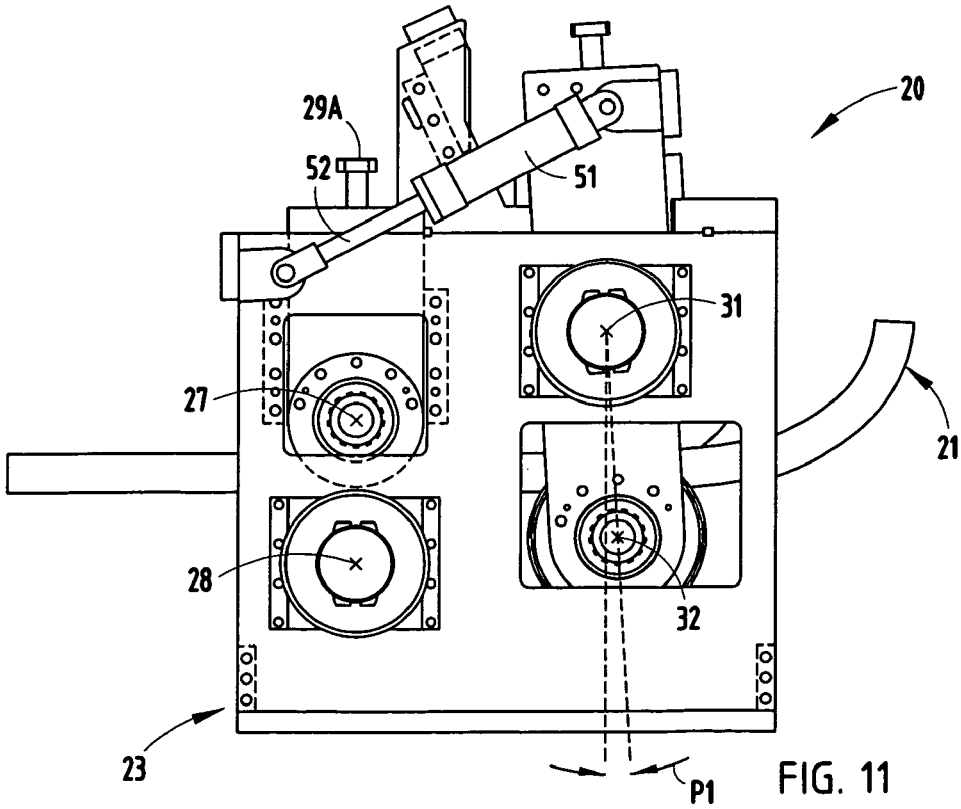

The illustrated support is provided in the form of a sliding "bridge" support 70 (FIG. 9A). The support 70 has an arcuate shape that generally matches the curved front of the bottom roller 63. In particular, the bridge support 70 is supported by anchoring structure 71 extending below (and/or extending laterally) from the bridge support 70 to the main frame 23. A top of the bridge support 70 may include a smooth hard bearing material able to slidingly engage the bottom surface of the continuous beam 21. Alternatively, a top of the illustrated bridge support 70 may include relatively small diameter roller-pin-like rollers (such as one or two inches in diameter) that rollingly engage and support the continuous beam 21 at locations close to the rollers 62 and 63. Additional support rollers can be positioned to engage sides of the continuous beam 21 at locations either in front of or after the rollers 62 and 63. These additional rollers would have an axis of rotation that extends vertically, and also could be a smaller diameter. The illustrated bridge support 70 has arcuately shaped front and rear surfaces so that it can be positioned as close as possible to the bottom rollers 61 and 63.

Also, it is contemplated that support can be provided inside the tubular beam by an internal mandrel stabilized by an upstream anchor (see FIG. 1, anchor 72), similar to the snake-like internal mandrels taught in Sturrus U.S. Pat. No. 5,092,512. It is noted that an internal mandrel may not be necessary for most bumper cross sections and sweeps . . . especially open beam sections and/or beam sections having a relatively short depth dimension and/or having minimal sweeps (i.e., sweeps that define a large radius).

Figure 5:
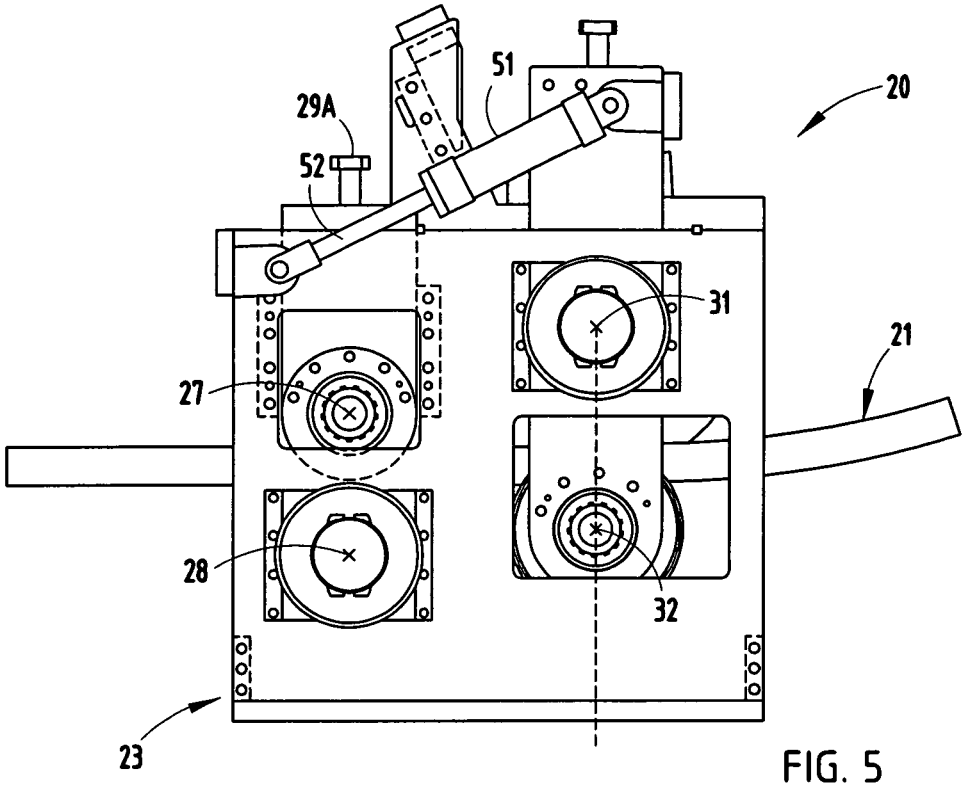
FIGS. 5-8 are side, top, rear (downstream side), and front (upstream side) of the sweep station of FIG. 3.
Figure 6:
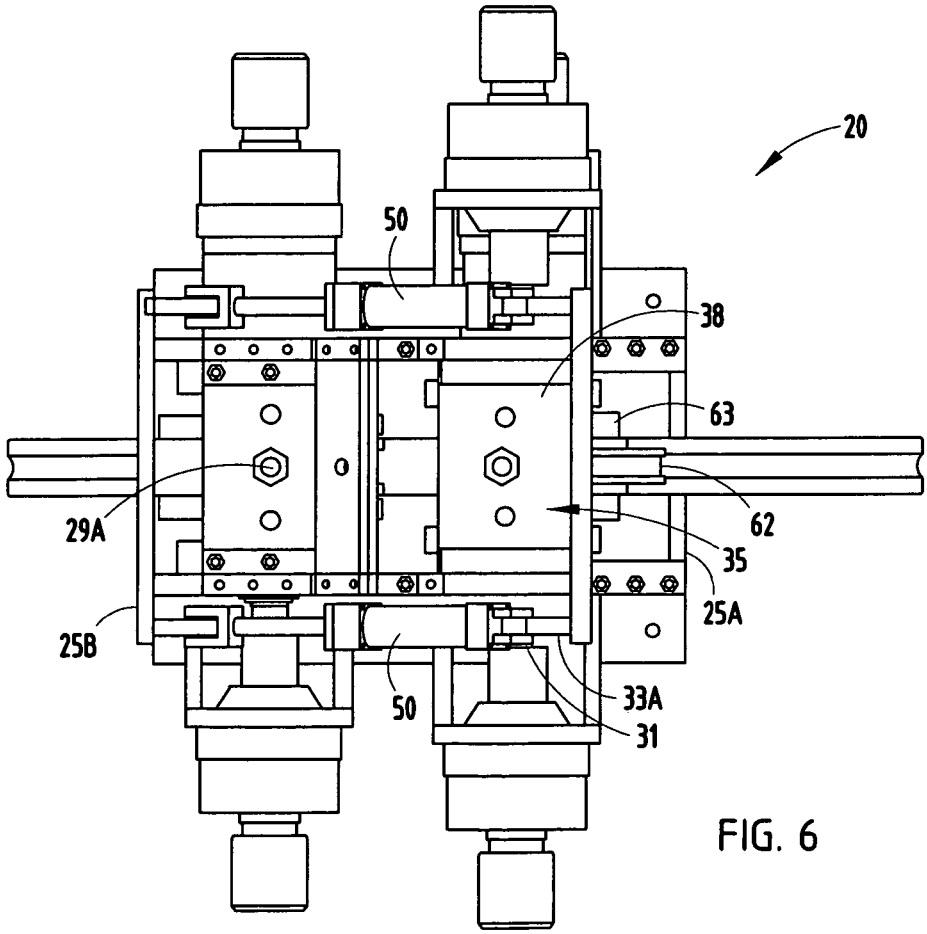
Figure 7:
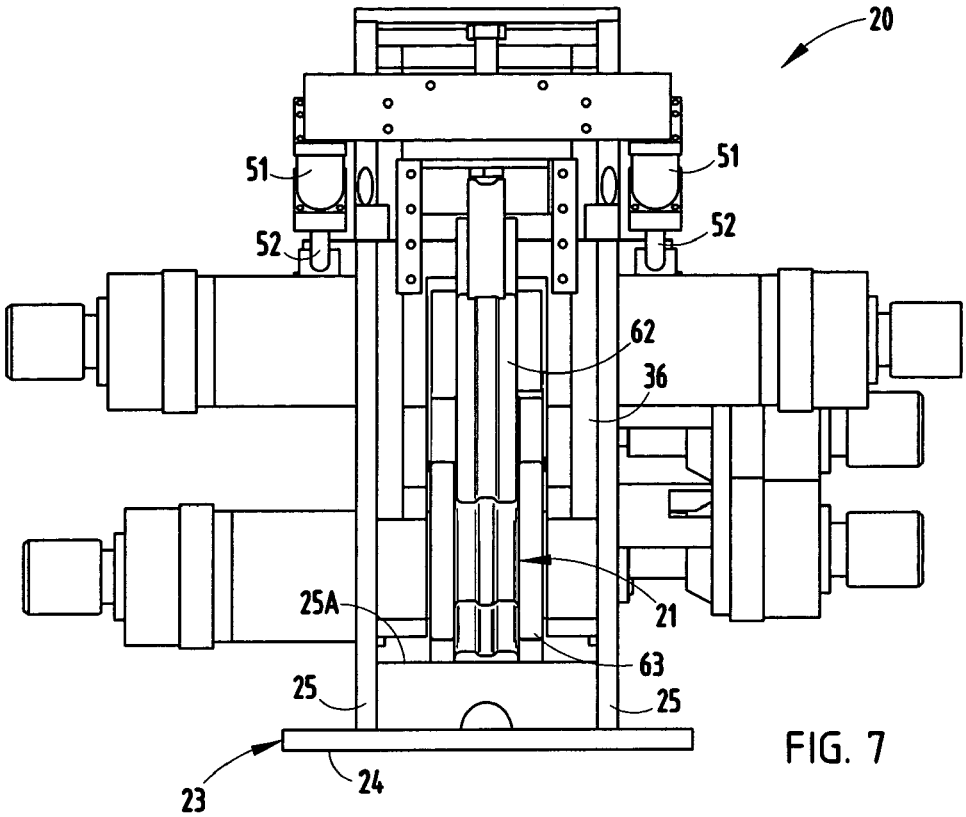
Figure 8:
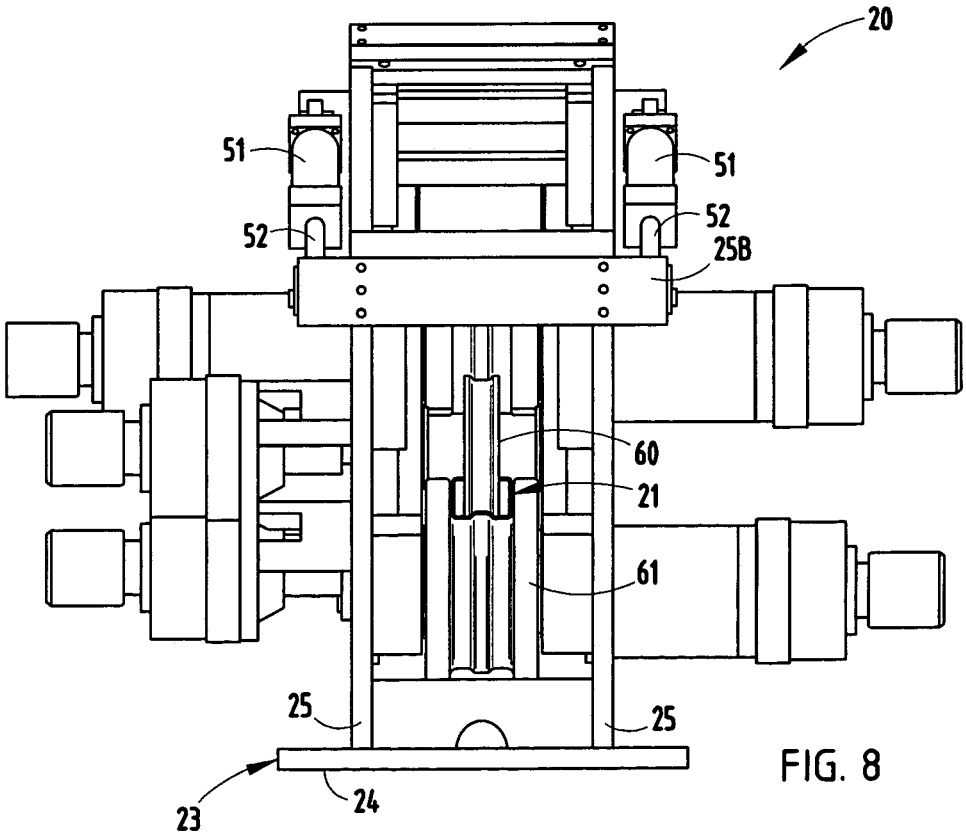

A pair of actuators 50 (FIG. 3) are operably attached between the main frame 23 and the sweep subframe 35 for angularly adjusting the subframe 35, one being on each side of the subframe 35. Each actuator 50 includes a cylinder 51 (FIG. 5) mounted at one end to a top of the subframe 35, and include an extendable/retractable rod 52 attached at an opposite end to the base 23. When the rod(s) 52 is retracted, the subframe 35 is rotated on the axle 31, thus changing the relative angular position of the subframe 35 about axle 31. (Compare FIGS. 9 and 9A.) Since the axis of rotation is at the center of the top axle 31, stresses are optimally located at a location as far downstream as possible, where the primary roller in the sweep station provides good support for the continuous beam 21. The actuators 50 are connected to a hydraulic circuit 55 (FIG. 3) adapted to provided a variable (but balanced) supply of hydraulic fluid to the cylinders 51. The hydraulic circuit 55 includes a motor or pump operably connected to and controlled by a computer controller 56 for controlling extension and retraction of the actuators 50 in coordination with the roll-forming apparatus 20. (The same computer controller 56 also controls the roll mill and the drives for the different axles of the sweep station.) Sensors can be located on the sweep station as desired for sensing a position of subframe 35 and/or for sensing a position of the continuous beam 21 (such as a locating hole in the beam 21 added for said purpose by the apparatus 19, if desired).

By this arrangement, the degree of sweep (curvature) can be varied in a controlled cyclical/repeated manner as the beam 21' is being made. For example, this allows the beams 21' to be given a greater sweep at their ends and a lesser sweep in their center sections immediately "on the fly" while roll-forming the beams. Due to the fast-acting nature of the actuators 50 and the efficient and controlled nature of the sweep station including positioning of the rollers 62, 63, the changing sweeps can be effected quickly and accurately, even with line speeds of 2500 to 5000 feet per hour. Notably, the movement of the roller 63 around the axis of roller 62 imparts a natural wrapping action to the beam 21 as the beam 21 is "drawn" around the roller 62 . . . such that the sweeps formed thereby are well-controlled and the mechanism is durable and robust.

The adjustable bottom roller 63 effectively holds the continuous beam 21 tightly against a downstream side of the circumferential surface of the top roller 62 when the bottom roller 63 is rotated around the axis of the top roller 62. For this reason, the top roller 62 is sometimes called the "forming roller" and the adjustable bottom roller 63 is sometimes called the "pressing roller" or "retaining roller." It is contemplated that the adjustable bottom roller 63 could potentially be replaced (or supplemented) by a separate holding device designed to grip and hold the continuous beam 21 against (or close to) the circumference of the top roller 62 as the continuous beam 21 wraps itself partially around the top roller 63. For example, the separate holding device could be an extendable pin or rod-like arm that extends under the beam 21 and is carried by rotation of the roller 62 partially around the axle to the roller 62, thus forming a short radius sweep. The "tight" sweep would be long enough such that, when the beam sections 21' are cut from the continuous beam 21, half of the short radius sweep forms a last section of a (future) beam section 21' and also the other half forms the first section of a (subsequent future) beam section 21'.

It is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. An apparatus comprising:

a roll-forming apparatus adapted to roll-form a sheet of material into a continuous beam having a longitudinal line level, the continuous beam having a first surface and an opposing second surface; and a sweep station in-line with the line level and adapted to form a longitudinal shape into the continuous beam; the sweep station including a primary bending roller tangentially engaging the continuous beam along the line level and an armature for holding the continuous beam tightly against the primary bending roller for a distance partially around a downstream side of the primary bending roller to form a sweep and further including actuators for adjustably moving the armature at least partially around the downstream side of the primary bending roller between at least first and second positions for imparting at least first and second different longitudinal shapes, respectively, into the continuous beam, the sweep station including stationary side plates supporting a primary axle for the primary bending roller, and the armature including an inverted U-shaped subframe supporting a holding roller, the subframe including legs pivoted to the primary axle with the holding roller at one end, the actuators being operably connected to the subframe.

2. The apparatus defined in claim 1, including a controller operably connected to the roll-forming apparatus and to the actuators for controlling operation of the roll-forming apparatus and the actuators in a coordinated manner resulting in a repeated series of different sweeps being imparted into the continuous beam at regular intervals.

3. The apparatus defined in claim 2, wherein the controller is programmed to repeatedly move the actuators to cause a repeating pattern where the first longitudinal shape is linear and the second longitudinal shape is non-linear.

4. The apparatus defined in claim 2, wherein the controller is programmed to repeatedly move the actuators to cause a repeating pattern where the first longitudinal shape defines a first radius and the second longitudinal shape defines a second radius different than the first radius.

5. The apparatus defined in claim 1, wherein the armature is rotated around a pivot axis that is located on an axis of rotation of the primary bending roller.

6. The apparatus defined in claim 1, wherein the armature includes a holding roller tangentially engaging the continuous beam and pressing the continuous beam against the primary bending roller, the armature being supported for movement along an arcuate path that defines an axis located on a same side of the continuous beam as an axis of the primary bending roller.

7. The apparatus defined in claim 1, wherein the primary bending roller rotates on a first axis, and wherein the armature is mounted for angular adjustment on the sweep station around the axis of the primary bending roller.

8. The apparatus defined in claim 1, wherein the actuators cause a repeating pattern in the continuous beam that includes the first and second longitudinal shapes, and including a cutter constructed and adapted to separate the continuous beam into individual bumper beam segments, with the first and second different longitudinal shapes being at predetermined symmetrical locations along a length of the individual bumper beam segments.

9. The apparatus defined in claim 8, including a controller operably connected to the roll-forming apparatus, the actuators and the cutter; the controller being programmed to automatically change a position of the armature to repeatedly selectively change the sweep imparted into the continuous beam while the roll-forming mill is rolling the continuous beam, the controller further being programmed to selectively operate the cutter to cut the continuous beam into beam segments such that each successive beam segment is symmetrical about a perpendicular plane bisecting the beam segment at its longitudinal mid-point.

10. The apparatus defined in claim 1, including a programmable controller operably connected to the actuator of the sweep station and programmed to cause the sweep station to make a repeating variation of the longitudinal shape of the continuous beam.

11. The apparatus defined in claim 1, wherein the roll-forming apparatus is configured to produce the continuous beam at line speeds of at least 900 feet per hour, with the sheet being at least 80 KSI tensile strength.

12. The apparatus defined in claim 1, including a bridge support adjacent the holding roller, the bridge support being located upstream of the holding roller and on a same side as the holding roller.

13. An apparatus comprising:

a roll-forming apparatus adapted to roll-form a sheet of material into a continuous beam having a longitudinal line level, the continuous beam having a first surface and an opposing second surface; and a sweep station in-line with the line level and adapted to form a longitudinal shape into the continuous beam; the sweep station including a primary bending roller tangentially engaging the continuous beam along the line level and an armature for holding the continuous beam tightly against the primary bending roller for a distance partially around a downstream side of the primary bending roller to form a sweep and further including actuators for adjustably moving the armature at least partially around the downstream side of the primary bending roller and about an axis of the primary bending roller between at least first and second positions for imparting at least first and second different longitudinal shapes, respectively, into the continuous beam, wherein the armature includes a holding roller pressing the continuous beam against the primary bending roller, the holding roller and the primary bending roller each being mounted on first and second axles, and including first and second motors for independently driving the first and second axles, respectively, and further including a controller operably connected to the roll-forming apparatus, the actuators, and the first and second motors for controlling the same in a coordinated manner, including variably controlling the first and second motors at different speeds based on a selected one of the first and second longitudinal shapes being formed by the sweep station.

14. The apparatus defined in claim 13, wherein the controller is programmed to repeatedly move the actuators to cause a repeating pattern where the first longitudinal shape is linear and the second longitudinal shape is non-linear.

15. The apparatus defined in claim 13, wherein the controller is programmed to repeatedly move the actuators to cause a repeating pattern where the first longitudinal shape defines a first radius and the second longitudinal shape defines a second radius different than the first radius.

16. The apparatus defined in claim 13, wherein the actuators cause a repeating pattern in the continuous beam that includes the first and second longitudinal shapes, and including a cutter constructed and adapted to separate the continuous beam into individual bumper beam segments, with the first and second different longitudinal shapes being at predetermined symmetrical locations along a length of the individual bumper beam segments.

17. The apparatus defined in claim 16, wherein the controller is further programmed to selectively operate the cutter to cut the continuous beam into beam segments such that each successive beam segment is symmetrical about a perpendicular plane bisecting the beam segment at its longitudinal mid-point.

18. The apparatus defined in claim 13, wherein the roll-forming apparatus is configured to produce the continuous beam at line speeds of at least 900 feet per hour, with the rollers configured to form a sheet having at least 80 KSI tensile strength.

19. An apparatus comprising:

a roll-forming apparatus adapted to roll-form a sheet of material into a continuous beam having a line level, the continuous beam having a first surface and an opposing second surface;

a sweep station in-line with and downstream of the roll-forming apparatus and adapted to form a longitudinal shape into the continuous beam; the sweep station including a first roller and a second roller opposite the first roller that opposes the first roller to pinch the continuous beam therebetween, and including a mechanism for controllably adjusting a position of the second roller, the first roller being positioned to tangentially engage the first surface of the continuous beam and being maintained in a relatively stationary position when roll-forming the continuous beam, the second roller also being positioned to tangentially engage the second surface of the continuous beam, the first roller defining a first axis of rotation and the second roller being movable by the mechanism along an arcuate path around an adjustment axis that is on a same side of the continuous beam as the first axis and that is located at or upstream of the first axis so that, upon adjustment, the second roller moves toward a position that is more downstream relative to the first roller, wherein the first and second rollers are mounted on first and second axles, respectively; first and second motors connected to the first and second axles, respectively; and wherein the mechanism includes actuators; a controller operably connected to the roll-forming apparatus, the actuators, and the first and second motors for controlling the same in a coordinated manner, including variably controlling the first and second motors at different speeds based on a selected one of the first and second longitudinal shapes being formed by the sweep station.

20. The apparatus defined in claim 19, including a controller connected to and controlling the mechanism to cause the longitudinal shape to form a repeating pattern of different longitudinal curvatures.

21. The apparatus defined in claim 19, wherein the adjustment axis is axially aligned with the first axis.

22. An apparatus comprising:

a sweep apparatus including at least first and second axles for supporting rollers that are adapted to form a sweep into a continuous beam;

an armature operably mounted on a stationary one of the axles, the armature supporting at least a particular one of the first and second rollers for imparting a sweep into the continuous beam; and an automated adjustment device including actuators for repeatedly arcuately adjusting an angular position of the armature to create a repeating pattern of longitudinal shapes in the continuous beam, the device including at least a first and second motors connected to the first and second axles, respectively, and a controller for controlling the first and second motors and the actuators, including variably controlling the first and second motors at different speeds based on a selected one of the longitudinal shapes being formed by the sweep apparatus, the device automatically moving the particular one roller toward different downstream positions relative to the other roller to change the sweep being imparted into the continuous beam.

23. An apparatus comprising:

a sweep apparatus including axles for supporting rollers that are adapted to form a sweep into a continuous beam;

an armature operably mounted on a stationary one of the axles, the armature supporting at least a particular one of the rollers for imparting a sweep into the continuous beam; and an automated adjustment device for repeatedly arcuately adjusting an angular position of the armature to create a repeating pattern of longitudinal shapes in the continuous beam, including automatically moving the particular one roller toward different downstream positions relative to the other roller to change the sweep being imparted into the continuous beam;

wherein the armature includes an inverted U-shaped subframe operably mounted to the stationary one of the axles and supporting a movable one of the axles, and including at least one actuator connected to the subframe for motivating the movable axle between selected positions around the stationary one axle.

* * * * *